United States Patent [19]

Steiman

[11] 3,937,366

[45] Feb. 10, 1976

[54] HAND-HELD PUMP TYPE DISPENSER

[75] Inventor: Wolf Steiman, Bridgeport, Conn.

[73] Assignee: VCA Corporation, Greenwich, Conn.

[22] Filed: Apr. 5, 1974

[21] Appl. No.: 458,338

[52] U.S. Cl. ..... 222/321; 222/385; 239/333

[51] Int. Cl.[2] ..... B67D 5/42

[58] Field of Search ..... 222/321, 383, 384, 385, 222/569, 320; 239/333, 600

[56] References Cited

UNITED STATES PATENTS

| | | | |
|---|---|---|---|
| 2,673,661 | 3/1954 | Barton | 222/569 X |
| 3,333,549 | 8/1967 | Cooprider | 222/383 X |
| 3,746,260 | 7/1973 | Boris | 222/321 X |
| 3,774,849 | 11/1973 | Boris | 222/321 X |
| 3,779,464 | 12/1973 | Malone | 222/321 X |

FOREIGN PATENTS OR APPLICATIONS

| | | | |
|---|---|---|---|
| 943,728 | 12/1963 | United Kingdom | 222/321 |

*Primary Examiner*—Robert B. Reeves
*Assistant Examiner*—Charles A. Marmor
*Attorney, Agent, or Firm*—H. Gibner Lehmann; K. Gibner Lehmann; E. Donald Mays

[57] ABSTRACT

A hand-held pump dispenser comprising a container having a neck portion, a pump assemblage including a piston and a tubular stationary cylinder member, the latter being adapted for disposition in the neck portion, and a resilient press-fit adapter carrying the cylinder member of the pump assemblage and arranged for insertion in the neck portion so as to make a tight press fit therewith. Interlocking means are provided on the cylinder member and on the adapter for enabling the latter to be snapped onto the member; additional means on the container neck and the adapter are provided for enabling the two parts, when assembled, to be snapped into the neck portion. The arrangement is such that all parts can be readily molded in simple mold cavities and easily assembled with a minimum of time and effort, and in the absence of special tooling or equipment.

1 Claim, 7 Drawing Figures

HAND-HELD PUMP TYPE DISPENSER

RELATED PRIOR ART

U.S. Pat. No. 3,159,316, entitled "Atomizer Pump", and having common ownership with the present application.

BACKGROUND

This invention relates generally to atomizer pump devices and more particularly to mounting arrangements for securing the pump mechanisms within an outer container or bottle.

In the past, various mounting arrangements have been employed for securing actuator mechanisms within containers. U.S. Pat. No. 3,159,316 illustrates an atomizer pump dispenser comprising an outer container or bottle, a cylinder structure disposed in the neck of the container and a piston reciprocably movable in the cylinder. The latter has an annular flange which is permanently clamped against the lip of the bottle neck by means of a crimped ferrule, the latter constituting the mounting means for the pump cylinder.

Still other constructions involved screw caps which were received on correspondingly threaded portions on the necks of the containers, and flanged pump cylinders wherein the flange was clamped between the lip of the neck and the screw cap as the latter was tightened.

While these constructions were satisfactory, from the standpoint of smooth operation and reliable use, they were often rather expensive to manufacture and involved considerable time for assembly. Dispensers employing ferrules required special crimping equipment, the latter being quite costly. In addition, dispensers of the type involving screw caps and threaded necks were also relatively expensive from the standpoint of manufacturing cost and assembly time.

SUMMARY

The above drawbacks and disadvantages of prior pump cylinder mounting arrangements are obviated by the present invention which has for an object the provision of a novel and improved wholly press-fit pump dispenser which is simple in construction, inexpensive to fabricate, and extremely easy to assemble. A related object is the provision of a pump as above, which is constituted of a minimum number of separate pieces, such pieces being capable of molding in simple mold cavities. A still further object is the provision of a dispenser which can be assembled without any special tooling or expensive equipment.

The above objects are accomplished by a pump dispenser comprising a container having a neck portion, a pump assembly including a stationary tubular member adapted to be disposed in the neck portion, and a resilient annular adapter carrying the stationary member of the pump assemblage and being insertable in the neck portion of the container so as to make a tight seal therewith and with the tubular member of the pump assemblage. First and second interlocking means are provided on the neck portion of the container and the adapter, and on the adapter and the stationary member, respectively, for enabling the adapter to be snapped onto the tubular member of the pump assemblage, and for subsequently enabling this assemblage to be snapped into the container neck. The arrangement is such that there is a minimum number of separate pieces constituting the dispenser, and the various parts can be readily and easily snapped together with a minimum of assembly time required.

Other features and advantages will hereinafter appear.

In the drawings, illustrating several embodiments of the invention:

Figure 1:
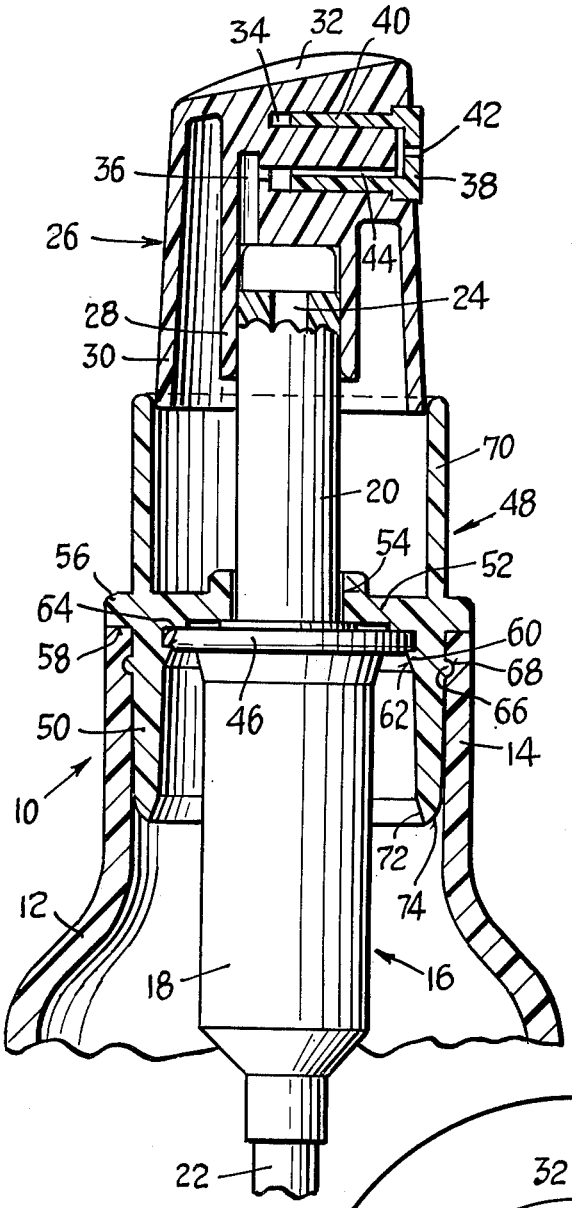
FIG. 1 is a fragmentary vertical section of the improved pump dispenser of the present invention, particularly illustrating the adapter securing the pump assemblage in the container neck.
Figure 3:
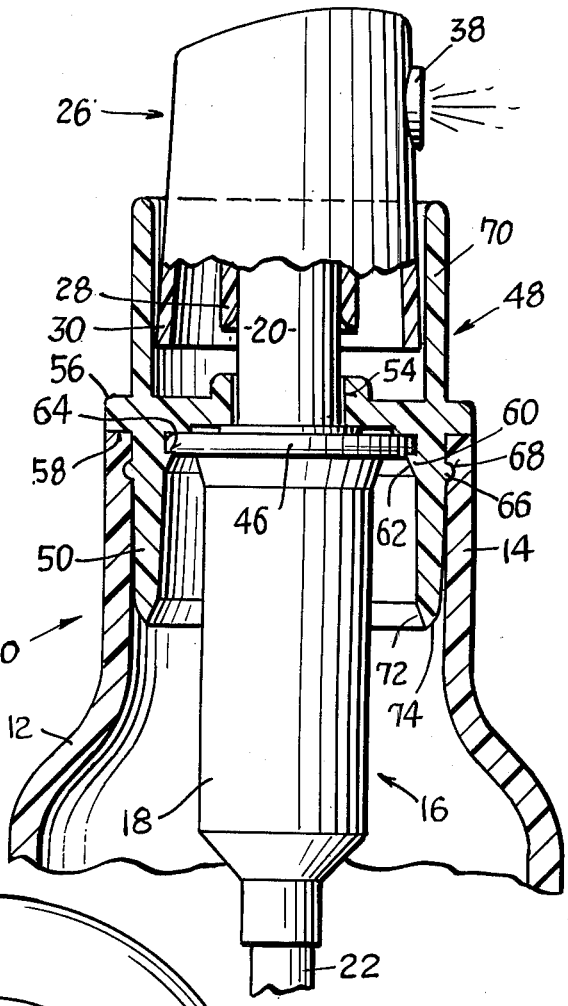
FIG. 3 is a view like FIG. 1, except showing the pump dispenser in the discharging condition.
Figure 2:
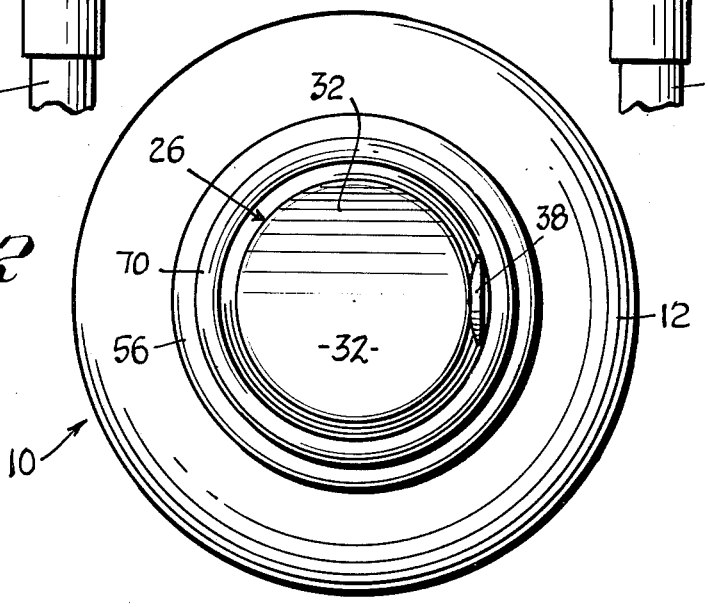
FIG. 2 is a top plan view of the dispenser of FIG. 1.

FIGS. 1–3 illustrate an atomizer pump dispenser generally designated by the numeral 10, comprising an outer container or bottle 12 having a neck portion 14, and a pump mechanism 16 disposed in the bottle and comprising a pump cylinder 18 and piston or plunger 20, reciprocably movable therein. A dip tube 22 is carried by the cylinder and communicates with the interior of the container, all in the usual manner.

The piston 20 has a discharge orifice 24 and receives a depress button 26. The button includes inner and outer annular skirts 28, 30, respectively, and a hollowed finger-engageable top surface 32. The button has an annular recess 34 connected with a vertical channel or connecting passage 36, which in turn communicates with the discharge orifice 24 of the piston. An orifice member 38 of cup-shaped configuration has an annular wall portion 40 which is pressed into and occupies a portion of the annular space 34. A discharge orifice 42 communicates with the annular space 34 by means of a groove 44 in one of the walls defining the space.

The pump mechanism is structurally similar to that illustrated and described in U.S. Pat. No. 3,159,316, and the details of the construction will not be repeated here. It is noted that the cylinder 18 has the form of a tubular member and has a flange 46 of annular configuration completely encircling it.

Figure 4:
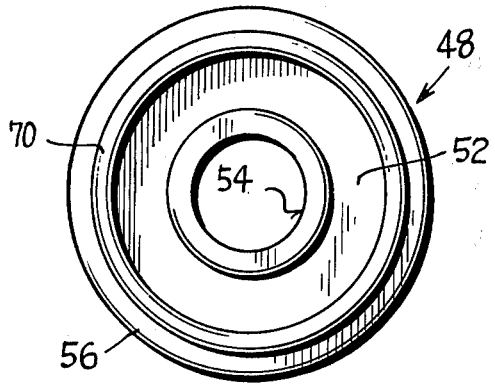
FIG. 4 is a top plan view of the adapter part of the dispenser of FIGS. 1–3.
Figure 5:
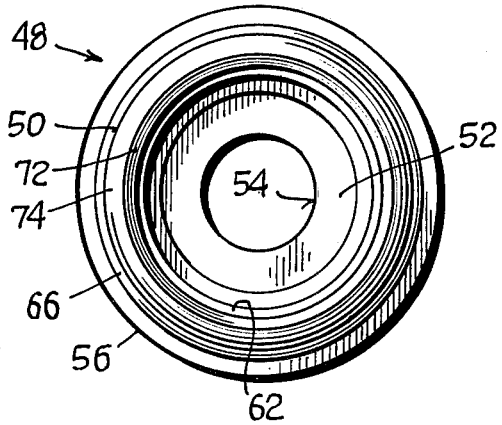
FIG. 5 is a bottom plan view of the adapter part of the dispenser of FIGS. 1–3.
Figure 6:
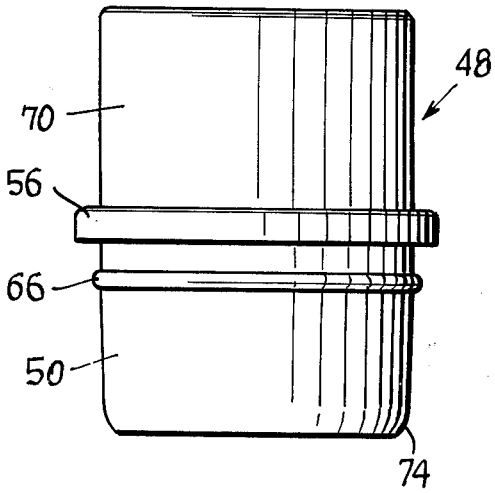
FIG. 6 is a side elevational view of the adapter part of the dispenser of FIGS. 1–3.

In accordance with the present invention, there is provided a novel adapter generally designated by the numeral 48, carrying the stationary member or pump cylinder 18 and being insertable in the neck portion 14 of the container. The adapter is particularly illustrated in FIGS. 4–6 and has a cup-shaped configuration with an annular wall portion 50 and a transverse wall portion 52. The latter includes a central aperture 54 through which the pump piston 20 extends as shown in FIG. 1. The adapter further includes an annular shoulder 56 which abuts the lip 58 of the container neck when held in place in the assembled dispenser.

By the present invention, the adapter 48 and pump cylinder 18 are provided with interlocking means for enabling the adapter to be snapped onto the cylinder during assembly, the interlocking means comprising the annular flange 46, and an internal bead 60 on the inner surface of the adapter. As shown, the bead has a wedge-shaped cross-sectional configuration, with one face 62 constituting a conical camming surface to facilitate by-pass of the flange 46 in one direction only, and with its opposite face 64 being undercut so as to engage the periphery of the flange 46 and permanently retain the latter.

By the present invention there is also provided an interlocking means on the inside of the container neck portion and on the exterior of the adapter, enabling the latter to be snapped into the neck and retained thereby, the means comprising an annular external bead 66 on the adapter and a grooved formation 68 on the inner surface of the neck portion 14. The present construction thus enables the dispenser to be readily assembled by simply snapping the parts together. The adapter 48 is first snapped onto the pump mechanism such that the flange 46 by-passes the bead 60, thereby engaging the transverse wall 52 of the adapter. This assembly is then readily inserted into the container neck such that the bead 66 is snapped into the grooved formation 68, such that the shoulder 56 engages the lip 58. The engagement of the bead 66 and groove 68, as well as that of the bead 60 and flange 46, are sufficiently tight so as to constitute completely leakproof seals. As a result, an especially simple, and inexpensive, yet reliable dispenser results.

To facilitate assembly of the dispenser, the lowermost edge of the annular wall 50 of the adapter in FIGS. 1–3 is provided with circular camming or guide surfaces 72, 74. The surface 72 tends to centralize the flange 46 with respect to the adapter 48 when the latter is being assembled to the cylinder 18. Similarly, the curved, convex surface 74 operates to guide the assembled adapter and pump mechanism into the neck 14 of the container, as can be readily understood.

Carried on the adapter 48 is an upstanding collar or skirt 70 which forms an annular recess into which the depress button is received during discharge of the dispenser. Such a dispensing condition is shown in FIG. 3. The skirt can be molded integral with the adapter, such that an especially neat and pleasing exterior appearance is had.

The above construction is seen to have a number of distinct advantages. The fabrication cost is low, since the molding of beads or grooves can be readily accomplished with simple molds, and is considerably less expensive than the molding of screw threads on caps, bottlenecks, and the like. Also, the assembly time is reduced to an absolute minimum, since each of the three parts can be readily snapped together in succession.

Figure 7:
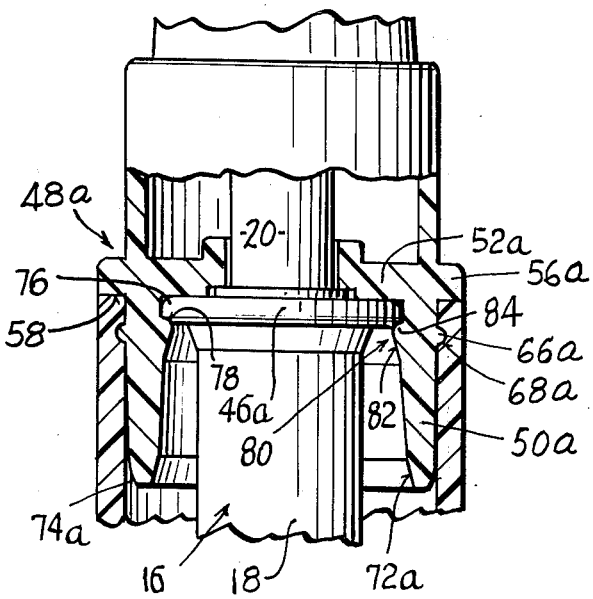
FIG. 7 is a fragmentary vertical section of a pump dispenser having a slightly modified adapter, constituting another embodiment of the invention.

Another embodiment of the invention is illustrated in FIG. 7, showing a fragmentary view of a somewhat modified adapter 48*a* and pump assemblage 16. As in the previous embodiment, the adapter has a cup-shaped configuration with an annular wall 50*a* and transverse bottom wall 52*a*. The wall 50*a* has an external bead 66*a* which is received in the groove 68*a* in the container neck. A shoulder 56*a* abuts the lip 58 of the neck as shown.

The pump assemblage 16 has an annular flange 46*a* having a periphery characterized by a convex surface 76 and a concave surface 78. In addition, the inner surface of the adapter has a bead 80 of generally arcuate cross sectional configuration, having a conical lower camming surface 82, and a convex upper surface 84. The arrangement is such that the camming surface 82 facilitates by-pass of the convex surface 76 during assembly of the adapter onto the pump mechanism. The flange 46*a* eventually becomes seated against the transverse wall 52*a* of the adapter. This construction enables the adapter to be removed or snapped off the pump assemblage, if desired at some later time, by virtue of the engagement of the gradually sloping surfaces 78, 84. As in the previous embodiment, the lowermost edge of the annular wall in FIG. 7 has camming or guide surfaces 72*a*, 74*a*, which operate in an analogous manner to those of the previous embodiment.

From the above it can be seen that I have provided a novel and improved pump dispenser construction which is both simple and inexpensive to produce, and easy to assemble. There are encountered no problems with mating threads or leaks occurring at the joints. The device thus represents a distinct advance and improvement in pump dispenser technology.

Variations and modifications are possible without departing from the spirit of the invention.

I claim:

1. An atomizer pump dispenser, comprising in combination:

a. a container with a neck portion having a cylindrical inner wall that is provided with an annular groove adjacent the upper end of the neck portion;

b. a resilient adaptor having i. a transverse wall portion having a central opening therein, ii. a cylindrical skirt portion integral with and depending from the transverse wall portion, the skirt portion being received in the neck portion of the container and being provided with a first annular bead on its exterior wall that is received in the groove, and the inner wall of the skirt portion being provided with a second annular bead adjacent its upper end, the lower end of the skirt having an arcuate bevel on its outer surface and an angular bevel on its inner surface;

c. a dispensing pump assemblage including i. a stationary tubular member having an outwardly extending flange at its upper end, the flange being sealingly received between the second annular bead and the bottom of the transverse wall, ii. a reciprocable plunger member projecting through the opening in the transverse wall; and d. said second annular bead having i. a conical surface on its underside constituting a camming surface to facilitate by-pass of the bead and the flange when the adapter and dispensing pump assemblage are assembled together, and ii. a sharp undercut surface adapted to receive the edge of the flange to enable by-pass of the flange and bead in one direction but prevent by-pass in the opposite direction.

* * * * *